United States Patent [19]

Hallerberg

[11] Patent Number: 4,892,053

[45] Date of Patent: Jan. 9, 1990

[54] TWIN-FLUKE MARINE ANCHOR HAVING LOOSELY COUPLED FLUKES

[76] Inventor: Don Hallerberg, 20 Bay Colony La., Ft. Lauderdale, Fla. 33308

[21] Appl. No.: 216,784

[22] Filed: Jul. 8, 1988

[51] Int. Cl.[4] ..... B63B 21/24

[52] U.S. Cl. ..... 114/303

[58] Field of Search ..... 114/298, 299, 301–308, 114/310

[56] References Cited

U.S. PATENT DOCUMENTS

| | | | |
|---|---|---|---|
| 21,841 | 6/1841 | Northrop et al. | 114/303 |
| 135,450 | 2/1873 | Smith . | |
| 270,168 | 2/1883 | Willis | 114/305 |
| 327,767 | 10/1886 | Coles . | |
| 527,060 | 10/1894 | House et al. | 114/299 |
| 536,177 | 3/1895 | Baker . | |
| 575,082 | 1/1897 | Tyzack . | |
| 652,162 | 6/1900 | Blackburn | 114/305 |
| 670,368 | 3/1901 | Byers | 114/310 |
| 1,258,119 | 3/1918 | Johannessen | 114/303 |
| 1,372,259 | 3/1921 | Martin | 114/305 |
| 1,373,741 | 4/1921 | Jones | 114/305 |
| 1,782,449 | 11/1930 | Siebert | 114/298 |
| 1,865,163 | 6/1932 | Bedell | 114/302 |
| 1,978,844 | 10/1934 | McLeland | 114/305 |
| 2,208,663 | 2/1938 | Conroy | 114/302 |
| 2,249,546 | 7/1941 | Danforth | 114/310 |
| 2,282,566 | 5/1942 | Danforth | 114/309 |
| 2,320,966 | 6/1943 | Danforth | 114/310 |
| 2,354,666 | 8/1944 | Danforth . | |
| 2,368,942 | 2/1945 | Northrop . | |
| 2,451,719 | 10/1948 | Danforth | 114/303 |
| 2,465,261 | 3/1949 | Pabst . | |
| 2,507,563 | 5/1950 | Farren | 114/304 |
| 2,576,172 | 11/1951 | Burleson, Sr. | 114/298 |
| 2,576,390 | 11/1951 | Danforth . | |
| 2,633,626 | 4/1953 | Danforth . | |
| 2,641,215 | 6/1953 | Danforth . | |
| 2,643,631 | 6/1953 | Danforth . | |
| 2,656,811 | 10/1953 | McRae . | |
| 2,687,106 | 8/1954 | Linnenbank et al. . | |
| 2,705,467 | 4/1955 | Ogg et al. | 114/310 |
| 2,722,191 | 11/1955 | Johnson | 114/304 |
| 2,797,657 | 7/1957 | Smith | 114/302 |
| 2,840,029 | 6/1958 | Ogg | 114/303 |
| 2,990,799 | 7/1961 | Morgan et al. | 114/298 |
| 2,994,292 | 8/1961 | Winslow | 114/298 |
| 3,045,633 | 7/1962 | Sarns | 114/298 |
| 3,071,096 | 1/1963 | Meno | 114/298 |
| 3,120,830 | 2/1964 | Northrop et al. | 114/309 |
| 3,382,835 | 5/1968 | McGuire | 114/308 |
| 3,428,014 | 2/1969 | Smith et al. | 114/298 |
| 3,771,486 | 11/1973 | Hungerford | 114/303 |
| 3,780,688 | 12/1973 | Hungerford | 114/303 |
| 3,822,665 | 7/1974 | Hungerford | 114/303 |
| 3,822,666 | 7/1974 | Blomberg | 114/310 |
| 3,858,543 | 1/1975 | Hungerford | 114/303 |
| 3,964,420 | 6/1976 | Stelling | 114/303 |
| 4,058,078 | 11/1977 | Stelling | 114/303 |
| 4,385,584 | 5/1983 | Simpson, III | 114/301 |

*Primary Examiner*—Joseph F. Peters, Jr.
*Assistant Examiner*—Jesûs D. Sotelo
*Attorney, Agent, or Firm*—Knobbe, Martens, Olson & Bear

[57] ABSTRACT

A lightweight aluminum anchor for marine vessels having removable flukes loosely coupled to an improved monolithic crown structure that has the same holding power as heavier, though similarly sized, steel anchors, yet is easily retrieved when it is no longer necessary to secure the vessel. The monolithic crown structure has oppositely disposed angled side walls integrally merging into the crown plates, resulting in the crown plates having a thicker and stronger center portion so that operational stresses of the anchor may be incurred without deforming the crown structure. Inset in each side wall is a fluke coupling member to which the flukes are attached that reduces the interior volume of the crown structure. The reduction of interior volume reduces the possible accumulation of debris, thereby making retrieval of the anchor much easier. Since all components of the anchor are made from extruded aluminum, no welding is required to assemble the anchor.

10 Claims, 3 Drawing Sheets

8
12
10
16
28
14
20

42
54
54
14
43
32
26
20
36
32
28
22
22

20
24
16
7
22
40
36
24
22
26
7
20

62
20
32
32
62
44
42
54
46
22
26
22
24
14
43
42
24
22
36
36
30
22
26
28
40
16

TWIN-FLUKE MARINE ANCHOR HAVING LOOSELY COUPLED FLUKES

BACKGROUND OF THE INVENTION

This invention relates to marine anchors and, more specifically, to a twin-fluke, lightweight, high performance aluminum anchor having removable twin flukes and a unique monolithic crown structure with the holding power and structural integrity of heavier steel anchors.

The anchor is an improvement over the anchors described in U.S. Pat. Nos. 2,249,546; 2,320,966; 2,641,215 and 2,643,631 to Danforth, U.S. Pat. Nos. 3,771,486; 3,780,688; 3,822,665 and 3,858,543 to Hungerford and U.S. Pat. No. 2,840,029 to Ogg, all having generally a shank, a stock and a pair of twin flukes coupled together by a crown structure.

When the anchor is resting on the underwater bottom, the anchor line or rode connects a boat or other marine vessel floating on the surface to the outer end of the shank. The anchor rode will pull the anchor forward along the bottom as the marine vessel drifts with the wind or tide. The crown structure resting on one side of its two crown plates tends to resist the forward motion, as well as elevating the after end of the anchor, thereby tipping the anchor such that the fluke tips are oriented downward toward bottom. As the anchor is drawn forward, the flukes will tend to bury themselves deeply into bottom. As the force on the rode is increased, the flukes will continue to bury themselves deeper and deeper into bottom, thus providing greater and greater holding power. It is not uncommon for a properly designed anchor to bury itself to the point where its uppermost surface is several feet under bottom. This condition has been observed in bottoms of mud, sand and even hard sand.

When attempting to set the anchor, the shank will pivot on the stock. In order to quickly set the anchor, it is desirable that the shank be able to rotate to provide an angle of 30°-35° relative to the effective surface of the flukes. If the angle is too great, the anchor will have difficulty in initially beginning the process of burying itself and, once begun, will likely become shod. That is, the planar portion of the flukes will likely become caked with mud, which will substantially reduce the anchor's holding power. If the angle is too small, the flukes will not be able to deeply penetrate the bottom since the burying resistance of the shank, crown and stock is working against the effective fluke surfaces which provide the burying forces. The maximum angular rotation of the shank in either direction is limited by contact with the crown.

A problem, especially prevalent with prior art lightweight anchors, is deformation and/or failure of the crown structure due to the concentrated force exerted by the shank on the crown plates. These forces tend to cause the plates to deform and/or structurally fail where the shank makes contact. As the deformation progresses, the angular rotation of the shank increases, greatly reducing the anchor's holding power. Eventually, the plates will separate from the supporting side walls, rendering the anchor unusable. The prior art has suggested some solutions to this problem, e.g., the use of heavier material such as steel or the use of exotic assemblages designed to spread the force exerted by the shank over a wide area, as shown in the Hungerford U.S. Pat. No. '486 patent. However, these prior art solutions introduce additional problems due to the additional weight and/or complexity and, most importantly, increase the burial resistance area and shape. The anchor's ability to have high holding power requires that the flukes be capable of burying the entire anchor including the crown, shank and stock to such a depth that the flukes have found their way down into the hard relatively compact bottom. It, therefore, is important that the resistance to the burying of the crown structure be minimized without sacrificing strength.

Additionally, due to the open box-like structure of the typical prior art crown structure, large amounts of mud, rocks or other debris will accumulate within the structure while the anchor is being set. The debris adds to the burying resistance as well as adding considerable weight to the anchor, making retrieval of the anchor very difficult. Of equal concern to the burying resistance is the restriction of the angular rotation of the shank when the anchor is broken loose due to a 180° change of wind or tide.

SUMMARY OF THE INVENTION

This invention relates to a twin-fluke anchor having a monolithic crown structure, a stock, a shank rotatably mounted to the crown, a pair of C-clips and a pair of flukes, each fluke having a flange along the inner edge, removably and loosely coupled to opposite sides of the crown.

The individual components of the anchor are advantageously manufactured from extruded aluminum resulting in a very lightweight anchor having the holding power of heavier anchors usually made of steel, while still possessing the necessary structural integrity. The design of the anchor permits complete assembly without the need of any welding.

The monolithic crown structure comprises two oppositely disposed members which may be thought of as substantially parallel plates connected and supported by a pair of oppositely disposed angled side walls. This structural shape of the side walls serves a two-fold function. First, it effectively reduces the interior and exterior volume of the crown structure. The reduced interior volume reduces the amount of debris that may accumulate within the crown, compared to a crown structure composed of straight side walls. The reduced exterior volume reduces the amount of resistance to burying. These reductions in volume result in less accumulation of debris which makes retrieval easier and reduces the possibility that the angular rotation of the shank will be restricted. The reduction in burying resistance allows the flukes to bury the entire anchor deeper, which provides a significant increase in the anchor's holding power. Secondly, since the crown structure is monolithic, the side walls integrally merge into the crown plates, resulting in a thickened central portion of the crown plates. Also, the union or merger between the crown plates and the side walls is substantially closer to the center of the crown plates, compared to crowns having straight side walls.

The side walls provide support for the crown plates in the area where the shank exerts considerable force when the anchor is in operation. The angled side walls also reduce the unsupported length of the crown plates between the shank contact area and the side walls/crown plate union, compared to the prior art. The structural integrity of the crown structure is thereby improved. Deformation or even complete separation of the crown plates, as was common with prior art straight wall crown structure designs, is now prevented.

The exterior portion of the side walls of the crown structure has an inwardly directed slot or opening running along the entire length of the side wall opening into a flange receiving member which is entirely inset into the side wall. An aperture is placed near the rear portion of each side wall on the inset portion of the receiving member so that the stock may be inserted.

The stock has a single groove or slot cut along its length such that, when the stock is inserted into the apertures of the side walls, the slot faces toward the front of the crown structure. The stock also rotatably couples the shank to the crown structure. The shank is inserted in the hollow cavity formed by the crown plates and the side walls, and extends outward through the open front of the crown structure.

The flukes are removably engaged with the inset flange receiving member by a flange along the inner edge of each fluke. The fluke is inserted from the front of the crown structure and abuts against the stock. The thin triangular portion of the fluke extends outward from the crown side wall through the slot. Since the flange is slightly smaller than the flange receiving member, the fluke will "float" within the flange receiving member, hence the term "loosely coupled."

The outer portion of each fluke is rigidly connected to the stock by a C-clip that encircles the stock and is clamped into place by a nut and bolt which passes through a hole in the outer edge portion of the fluke. When rigidly connected to the stock along the fluke's outer edge by the C-clips, the thin triangular portion of the flukes will be seated within the groove of the stock. Since the T-shaped flange along the fluke's inner edge prevents the thin triangular portion from seating within the groove near the crown, the flukes will assume a slight outward angle of approximately 4° relative to a vertical plane intersecting the crown plates of the crown structure. As a result, the distance between the outer tips of the respective flukes and the shank is increased. The increased distance provides stability, as does the stock, from rotation where the anchor tends to rotate about the shank axis.

DESCRIPTION OF THE PREFERRED EMBODIMENT

Figures 1, 2, 3:
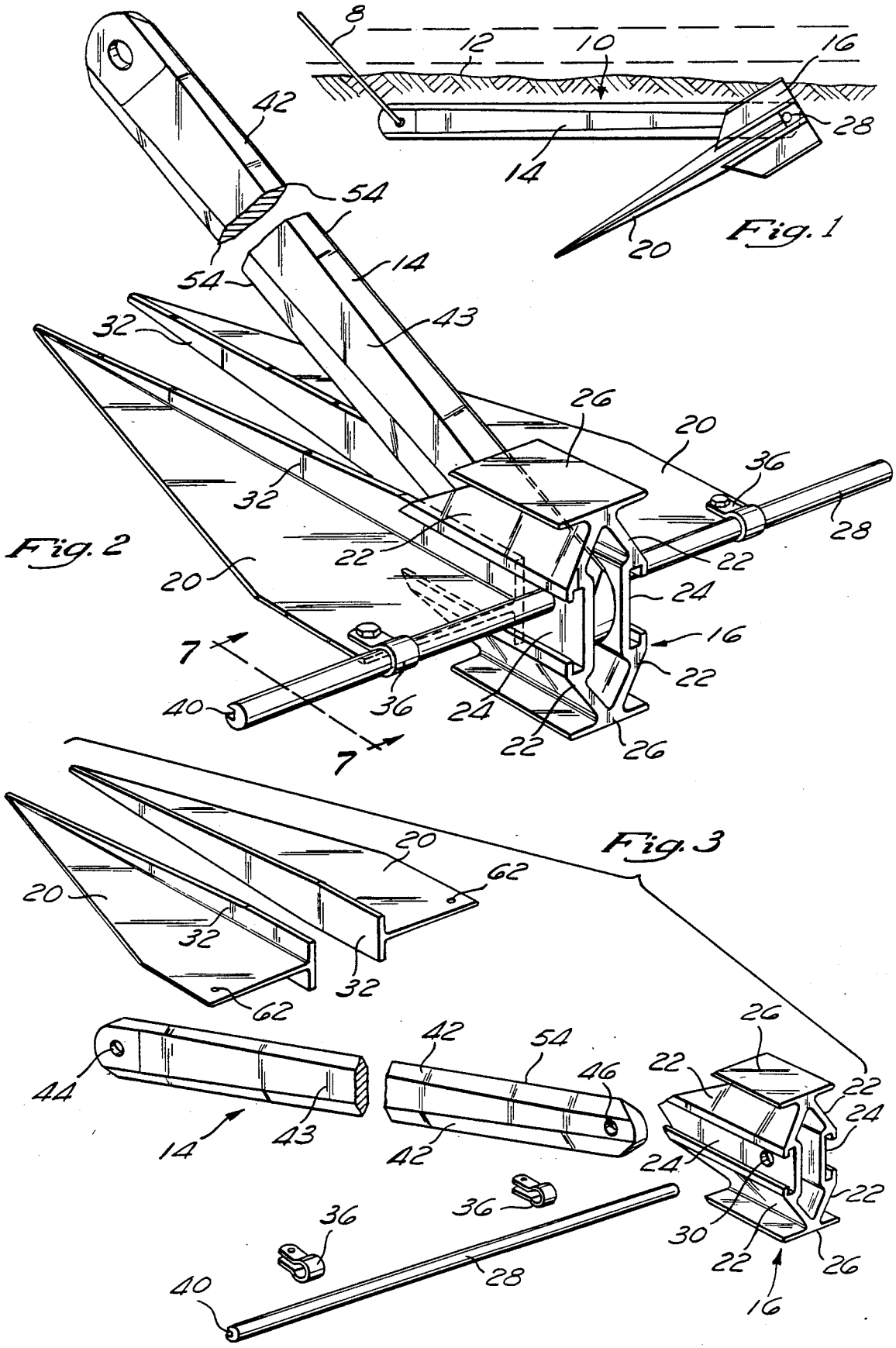
FIG. 1 is a side view of the invention once it has engaged the underwater surface.
FIG. 2 is a perspective view of an anchor constructed in accordance with the invention.
FIG. 3 is an exploded view of the anchor shown in FIG. 2.

Referring now to the drawings, and in particular to FIG. 1, an anchor 10 constructed in accordance with this invention is shown engaged with the underwater surface 12. The shank 14 is at its maximum angular extension, roughly parallel with the underwater surface 12. Further angular rotation is limited by contact with the monolithic crown structure 16. The monolithic crown structure 16 is completely embedded in the underwater surface 12 as typically occurs when the anchor 10 is engaged in sandy or muddy surfaces. The flukes 20 are shown deeply embedded in the underwater surface 12. An anchor rode 8, attached to the outer end of the shank 14, is used to connect the anchor 10 to a marine vessel, which is not shown, on the surface of a body of water.

FIG. 2 is a perspective view of the completely assembled anchor 10. The monolithic crown structure 16 is shown having a pair of oppositely disposed angled side walls 22 supporting oppositely disposed and essentially parallel crown plates 26. The merger of the side walls 22 into the crown plates 26 results in a thick central portion that effectively reinforces the monolithic crown structure 16 in this area. Along the exterior length of the side walls 22, a slot opens onto an inset flange receiving member 24 entirely inset into the wall 22.

The shank 14 is inserted between the side walls 22 and is pivotably coupled to the crown structure 16 by the stock 28 which passes through the side wall apertures 30, more clearly shown in FIG. 3.

The flukes 20 are loosely coupled to opposite sides of the monolithic crown structure 16. Each fluke 20 has a generally T-shaped flange 32 along the inner edge which movably couples the fluke 20 to the flange receiving member 24. Once coupled to the crown structure 16, the flukes 20 are abutted against and secured to the stock 28 by bolted C-clips 36.

Referring to FIG. 3, each fluke 20 is essentially triangular in shape, having a rear edge, an inner edge and an outer edge merging with the inner edge to form a point. A flange 32 along the inner edge portion of each fluke 20 extends to the rear edge of the fluke 20 so that, when viewed along the rear edge, the fluke/flange union appears T-shaped. Each fluke 20 also has an aperture, referred to as the fluke aperture 62, located near the outer rear edge portion.

Incorporated within the outwardly angled side walls 22 is a fluke retaining means. The fluke retaining means comprises a slot along the exterior length of the side walls, opening onto a recessed or inset flange receiving member 24. The inset member partially fills the interior volume of the crown structure. Two side wall apertures 30, oppositely disposed, are located near the rear edge of each inset flange receiving member 24. The side wall apertures 30 are appropriately sized so that the stock 28 may be freely inserted.

The stock 28 is an elongated circular or rod-like member, sufficient in length to extend beyond the outermost fluke 20 edges. It has a straight single slot 40 along its length. When the stock 28 is inserted through the side wall apertures 30, it is oriented such that the slot 40 is directed toward the front of the crown structure 16. As described in more detail below, slot 40 receives a portion of the rear edge of the flukes 20.

The shank 14 is an elongated member essentially rectangular in plan view having an octagonal cross section, preferably of uniform height along its length. The top and bottom surfaces 54 of the shank 14 are of a constant, relatively narrow width. The width of the cross section is uniform near each end of the shank 14, but is tapered in the portion between lines 41, 41*a*. Thus, the distal end of shank 14 is narrower than the proximal end attached to the stock 28. As a result, the beveled edges 42 of the shank 14 narrow concomitantly from the distal end of the shank to the proximal end of the shank attached to the stock 28. Because of the beveled edges 42, the shank 14, in cross section, has an octagonal configuration. The beveled edges 42 increase the contact area between the shank 14 and the crown plates 26, as will be more fully explained below.

An aperture at the distal portion of the shank 14, referred to as the outer shank aperture 44, is utilized to connect the anchor 10 to the anchor rode 8. It is shown as round but may be any appropriate geometrical shape. A second round aperture, referred to as the inner shank aperture 46, is located toward the proximal portion of the shank 14 and is appropriately sized such that the stock 28 may freely pass.

Figure 4:
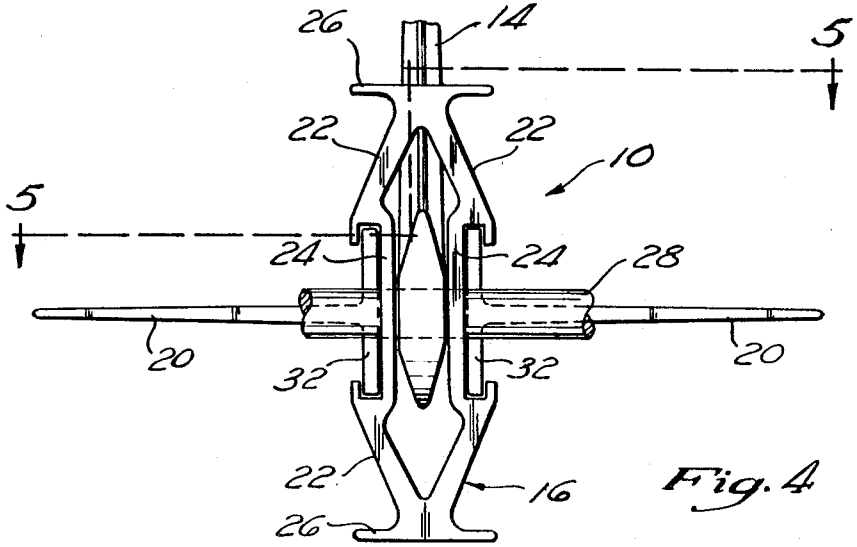
FIG. 4 is a rear view of the anchor shown in FIG. 2.

As shown in FIGS. 3 and 4, the shank 14 is inserted between the crown side walls 22 so that the inner shank aperture 46, shown in FIG. 3, is aligned with the crown side wall apertures 30. The stock 28 is inserted through the aligned apertures 30 and 46, effectively coupling the shank 14 to the crown structure 16.

Figure 5:
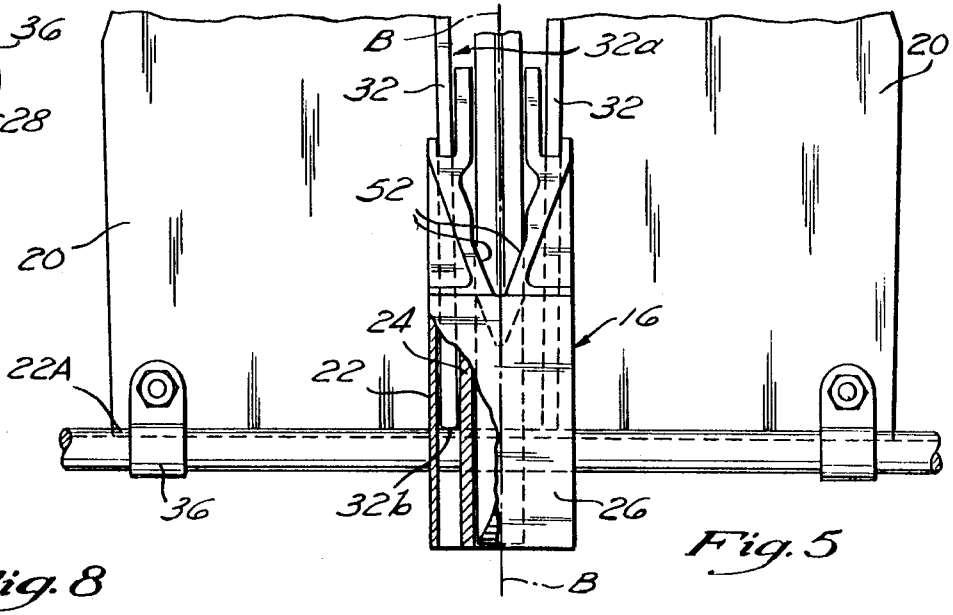
FIG. 5 is a top view of the anchor as seen approximately from the plane indicated by line 5—5 of FIG. 4.
Figure 6:
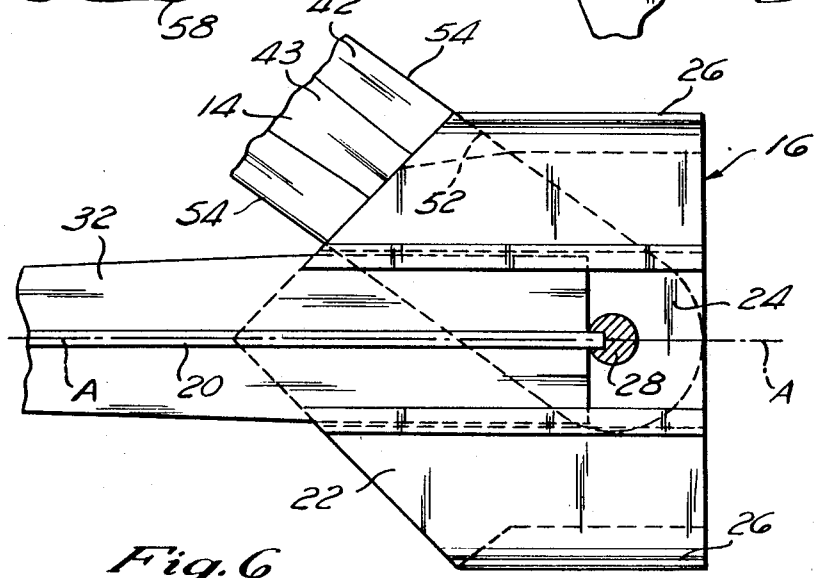
FIG. 6 is a partial side view of the anchor shown in FIG. 2.

Anchors constructed in accordance with this invention offer significant advantage. One particular feature of the present invention is the ability to resist deformation of the crown plates 26 caused by the concentrated forces exerted by the shank 14. As mentioned previously, the central portion of the monolithic crown structure is reinforced by the merger of the crown plates 26 and the side walls 22. An additional feature is described in FIGS. 3, 5–6 and 9, wherein the side walls 22 are shown to taper back from a point on the center line (indicated by line A—A) to the crown plates 26. As best shown in FIG. 5, the monolithic crown structure 16 is formed with a beveled notch 52 along the front edge portion where the tapered side walls 22 join the crown plates 26. The notch 52 is placed so that the shank 14 may rotate to the proper angular position so that the anchor 10 may engage with the underwater surface 12. This relationship is more clearly shown in FIG. 6 where the shank 14 is shown engaging the upper crown plate 26 at an angle of approximately 35° relative to the center line. When the anchor is engaged, the concentrated force exerted by the shank 14 on the crown plate 26 is quite large. To prevent damage, the contact area between the shank 14 and the crown plates 26 is increased by the beveled surfaces of each component. In this view, it is clear that the shank's top or bottom surface 54 engages the crown plate 26 rearward of the engagement of the beveled edges 42, thereby increasing the contact area compared to the point contact that would occur without the notches 52 and beveled edges 42.

Figure 9:
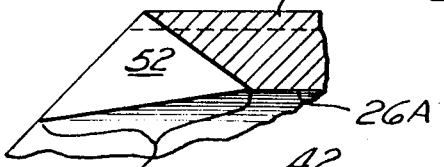
FIG. 9 is an expanded partial side view of the crown plate beveled notch portion.

A cutaway view of the beveled notch 52 formed into the front edge portion of the crown 16 is shown in FIG. 9. This figure clearly illustrates the face of the notch 52 which flares out to a width 58 along the interior portion of the crown 16. Since both the upper and lower portions of the crown 16 contain an oppositely and symmetrically disposed notch, the second notch is not shown. These beveled notches 52 increase the contact area between the shank 14 and the crown plates 26 by permitting contact between the beveled edges 42 of the shank 14 and the beveled notch 52. With the increase in contact area, the closely supporting side walls 22 and the thick center section, the crown plates 26 will not be deformed from the force exerted by the shank 14. Thus, the need to design exotic assemblages to prevent crown plate deformation or the need to use heavier materials such as steel for the crown structure is eliminated.

Figure 8:
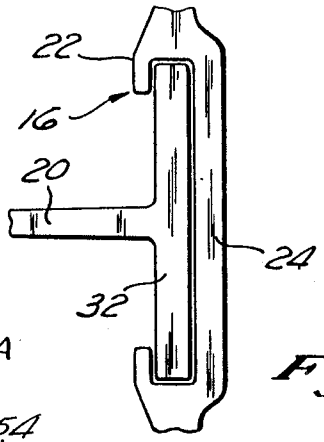
FIG. 8 is a partial front view of the anchor of FIG. 2 showing the crown/fluke coupling.

FIG. 8 is a front view of a section of the anchor 10, showing an expanded view of the flange 32 coupled to the flange receiving member 24. The flange 32 is smaller than the receiving member 24 such that the fluke 20 is loosely coupled to the crown structure 16. The triangular fluke portion 20 extends outwardly from the crown structure 16 through the slot in the side wall 22, while the flange 32 is retained by the inner portion of the crown side wall 16 or the exterior of the inset side wall portion 24.

Figure 7:
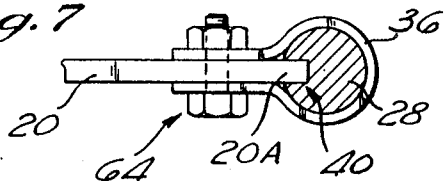
FIG. 7 is an enlarged view showing the attachment of the outer rear edge of the fluke to the stock as seen approximately from the plane indicated by line 7—7 of FIG. 2.

C-clips 36 are used to secure the flukes 20 to the stock 28, as previously mentioned. The inner diameter of the C-clip 36 is slightly smaller than the diameter of the aluminum stock 28. Once the anchor 10 is assembled, the use of the undersized C-clip 36 results in the stock 28 being firmly affixed to the flukes 20. FIG. 7 is a side view of the attachment of the thin triangular fluke portion 20*a* to the stock 28, as indicated from line 7—7 of FIG. 2. It should be noted that the fluke portion 20*a* is appropriately sized such that when abutted against the stock 28, the fluke portion 20*a* will seat within the slot 40 of the stock 28. The C-clip 36 encircles the stock 28 and secures the fluke 20 to the stock 28 through the fluke aperture 62 shown in FIG. 3. The C-clip 36 is shown secured with a nut and bolt assembly 64, but other methods of attachment may also beutilized, including semipermanent methods such as rivets. The flukes 20 are advantageously mounted in the preferred embodiment such that they assume a slight outward angle of between 2°–4° relative to a vertical plane intersecting the crown plates. Referring to FIG. 5, it may be seen that the flange 32 along the inner edge of the fluke 20 is seated within the C-shaped side wall receiving member 24 at an angle relative to a vertical plane through the crown structure 16, as generally indicated by line B—B. Thus, the front portion 32*a* of the flange 32 is further from the center line B—B of the monolithic crown structure 16 than the rear portion 32*b* of the flange 32. The rear portion of the flange 32*b* also abuts against the stock 28. Since the flange 32 is smaller than the flange receiving member 24, each fluke 20 is thereby essentially loosely coupled to opposite sides of the crown structure 16 prior to the fluke's 20 rigid attachment to the stock 28. The T-shaped fluke/flange union prevents the thin fluke portion 20*a* from seating into the single slot 40 of the stock 28 nearest the crown structure 16. However, the outer edge of the thin fluke portion 20*a* abuts against and is seated within the single slot 40 of the stock 28 and is secured thereto by means of the undersized C-clip 36, as is shown more clearly in FIG. 7. Both flukes 20 thus extend outwardly from the crown structure 16 at a slight angle of between 2°–4° relative to the shank center line B—B. This slight angle increases the distance between the tips of the flukes 20 and the shank 14 where the anchor rode 8 attaches to the shank 14. Since the distance is increased, there is an important degree of increased stability from rotation where the anchor 10 tends to rotate about the shank 43 axis, and there is more room to allow the shank 43 to pass between the flukes 20 when there is a 180° wind or tide change that causes the anchor 10 to reset itself.

Figure 10:
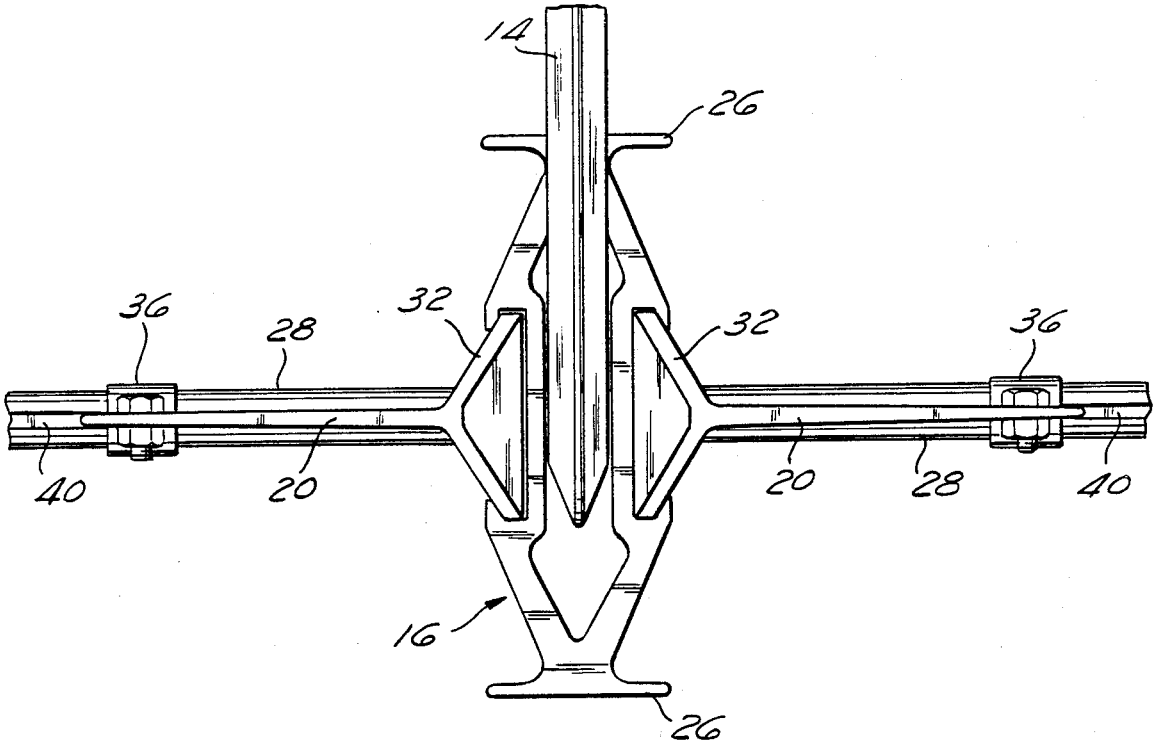
FIG. 10 is a front view of the anchor shown in FIG. 2.

Another significant advantage of this invention is that the interior and exterior volume of the crown structure is reduced. FIG. 10 is a front view of the anchor of FIG. 2. This view shows the surface area which presents the resistance to burying, which the flukes must overcome. Reduction of the exterior volume of the anchor concomitantly reduces this surface area. As a result of reducing the interior volume, the amount and weight of debris that may accumulate within the crown is minimized, thus simplifying retrieval of the anchor. By limiting the amount of debris within the crown, the invention also inhibits any restriction of the angular rotational movement of the shank relative to the crown caused by rocks, etc. lodged within the crown. The reduction in exterior volume complimented by the reduction of interior volume cumulatively results in a significant reduction of the burying resistance of the crown 16. This reduction in burying resistance allows the flukes 20 to bury significantly deeper and, therefore, provide much higher holding power.

This improved structure in the embodiment disclosed is best shown in FIG. 4, which illustrates the completely assembled anchor 10 as viewed from the rear. The T-shaped flange 32 of each fluke 20 is seen coupled to the crown structure 16. The angle of the side walls 22 and the union of the side walls 22 with the crown plates 26 near the center of the crown plates 26 resulting in the thicker center portion are features of the monolithic crown structure 16. As a result, the cross-sectional area of the crown structure 16 is substantially reduced when compared to the prior art crown structures having straight side walls. The interior volume of the crown structure 16 is further reduced by the inset flange receiving member 24. As discussed above, this reduced volume therefore reduces the amount of debris that may accumulate in the area between the crown side walls 22 that could potentially prevent the shank 14 from rotating to its maximum angular position.

As previously mentioned, each major component of the anchor is constructed of extruded aluminum. The use of extruded aluminum in other marine components is well documented, the aluminum mast being a common example of such use. When properly designed, the aluminum anchor has the same holding power as a similarly sized iron or steel anchor, but at a considerable savings in weight.

What is claimed is:

1. A twin-fluke anchor having a minimal volume within the anchor crown so as to minimize (a) the amount and weight of debris that may accumulate within the anchor crown, (b) restrictions upon angular movement of the anchor shank relative to the anchor crown that may be caused by debris lodged within the anchor crown, and (c) the burying resistance, resulting in higher holding power, said anchor comprising:

a monolithic crown structure;

a pair of flukes attached to said monolithic crown structure; and a shank rotatably mounted to said monolithic crown structure, said crown structure having (a) a pair of oppositely disposed crown plates, (b) a pair of oppositely disposed side walls integrally merging into said crown plates along the width of and near the center portion of said crown plates whereby the center portion of said crown plates is thicker than the outer portion of said crown plates, and (c) a pair of oppositely disposed fluke retaining means comprising a slot along the outer width of said side wall opening onto an inset flange receiving member whereby interior volume of said monolithic crown structure is reduced.

2. A twin-fluke anchor as in claim 1, wherein said side walls have a substantially angular shape.

3. A twin-fluke anchor as in claim 1, wherein said flange receiving member comprises an inset portion of said side walls.

4. A twin-fluke anchor as in claim 3, wherein said flukes have a flange which is smaller than said inset flange receiving member whereby said flukes may be loosely attached to said crown.

5. A twin-fluke anchor as in claim 1, wherein said anchor is made from extruded aluminum whereby a lightweight anchor having the same mooring capability as a heavier steel anchor is obtained.

6. A twin-fluke anchor, wherein said flukes are mounted to the anchor crown at a slight angle relative to a vertical plane through the center of the anchor crown to increase the distance between outer tips of the flukes and the shank minimizing potential obstruction of the flukes with the shank, said anchor comprising:

a crown;

a pair of flukes attached to said crown;

a shank rotatably coupled to said crown; and a stock having an open slot along substantially the length thereof, the outer edge portion of each fluke extending into said open slot and the inner edge portion being retained in contact with or closely proximate to the outer peripheral of said stock so that each fluke is canted at a slight angle with respect to the axis of the stock.

7. A twin-fluke anchor as in claim 6, wherein said stock rotatably couples said shank to said crown.

8. A twin-fluke anchor as in claim 6, wherein said angle is in the range of 2°–5°.

9. A twin-fluke anchor capable of mooring a marine vessel to prevent the vessel from drifting with wind or tide, said anchor comprising:

a crown structure;

a shank rotatably coupled to said crown;

a pair of flukes having a flange along the inner edge; and means for loosely coupling said flukes to opposite sides of said crown, comprising a pair of oppositely disposed fluke retaining means completely inset within the crown structure.

10. A twin-fluke anchor as in claim 9, wherein said flange is smaller than said fluke retaining means so that said flange loosely couples said flukes to said crown.

* * * * *